United States Patent [19]

Endriz et al.

[11] 4,001,619

[45] Jan. 4, 1977

[54] MODULATION MASK FOR AN IMAGE DISPLAY DEVICE

[75] Inventors: John Guiry Endriz, Plainsboro; Carmen Anthony Catanese, Rocky Hill, both of N.J.

[73] Assignee: RCA Corporation, New York, N.Y.

[22] Filed: Dec. 17, 1975

[21] Appl. No.: 641,502

[52] U.S. Cl. ..... 313/105 R; 313/400; 313/403; 313/411; 315/169 TV

[51] Int. Cl.[2] ..... H01J 43/00

[58] Field of Search ..... 313/103 R, 103 CM, 104, 313/105 R, 105 CM, 329, 395, 400, 402, 403, 411, 495; 315/169 TV

[56] References Cited

UNITED STATES PATENTS

| | | | |
|---|---|---|---|
| 2,951,175 | 8/1960 | Null | 313/329 X |
| 3,904,923 | 9/1975 | Schwartz | 313/103 R X |

*Primary Examiner*—Robert Segal
*Assistant Examiner*—Lawrence J. Dahl
*Attorney, Agent, or Firm*—Glenn H. Bruestle; Carl L. Silverman

[57] ABSTRACT

A metal sheet is provided with a plurality of slots which are disposed in parallel rows and columns. Charge sensing pads are disposed on an insulating layer on one surface of the metal sheet with a separate pair of the charge sensing pads being in abutting relation and sandwiching a separate slot. The sensing pads include a portion which extends beyond the length of the slot and is of a material having a high secondary emission ratio. The sensing pads have a capacitance to the metal layer such that they can be electrically charged to a common voltage level which permits a substantially uniform maximum electrical charge to pass into each one of the slots when the abutting sensing pads are discharged by line electron sources. The charge sensing pads may be repetitively charged, i.e., brought back to the common level, through secondary emission from the portions of the pads which extend beyond the slots. A plurality of substantially parallel modulating electrodes are disposed on, but insulated from, the other surface of the metal sheet. Each one of the modulating electrodes extends around one of the parallel columns of slots. The modulating electrodes control the charge which exits from each one of the slots during a charge-discharge cycle. The modulating mask is suitable for use with line electron sources to form a display having desirable characteristics. The modulation mask can be used in conjunction with feedback multiplier line sources as long as high energy electrons are eliminated through the use of high energy electron filters.

24 Claims, 12 Drawing Figures

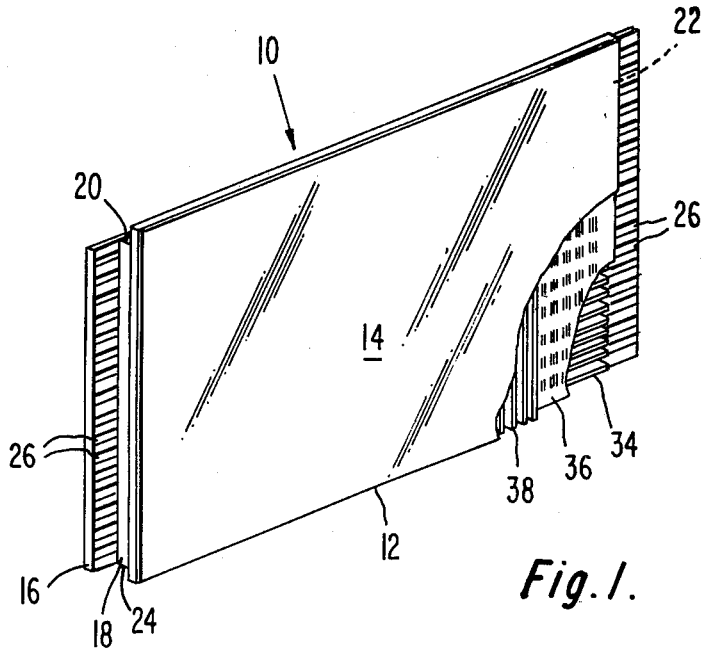
Fig. 1.
Fig. 3.
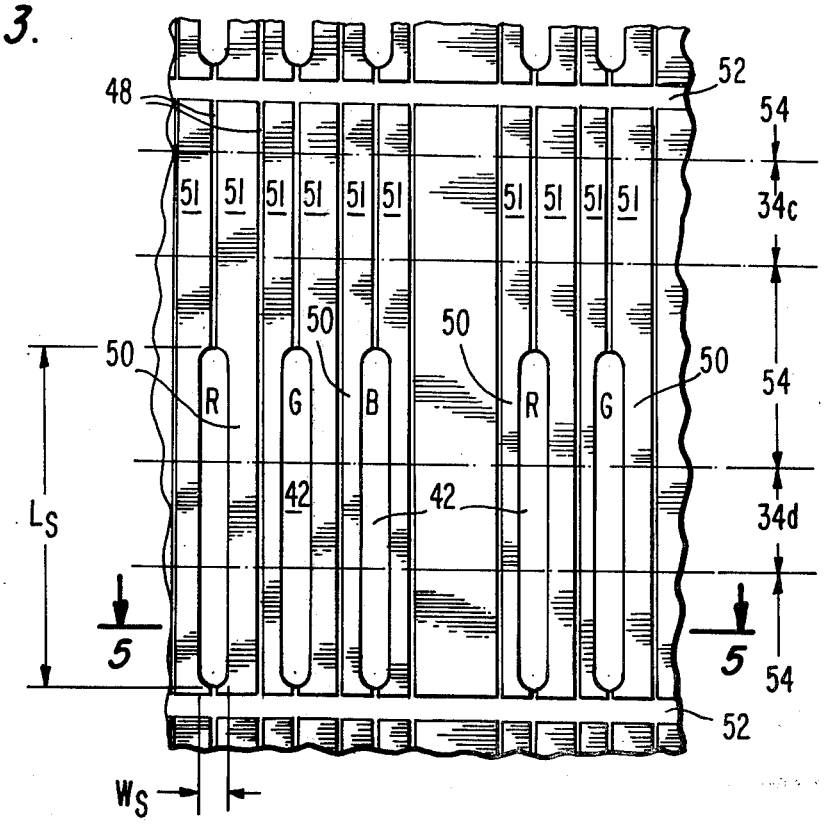

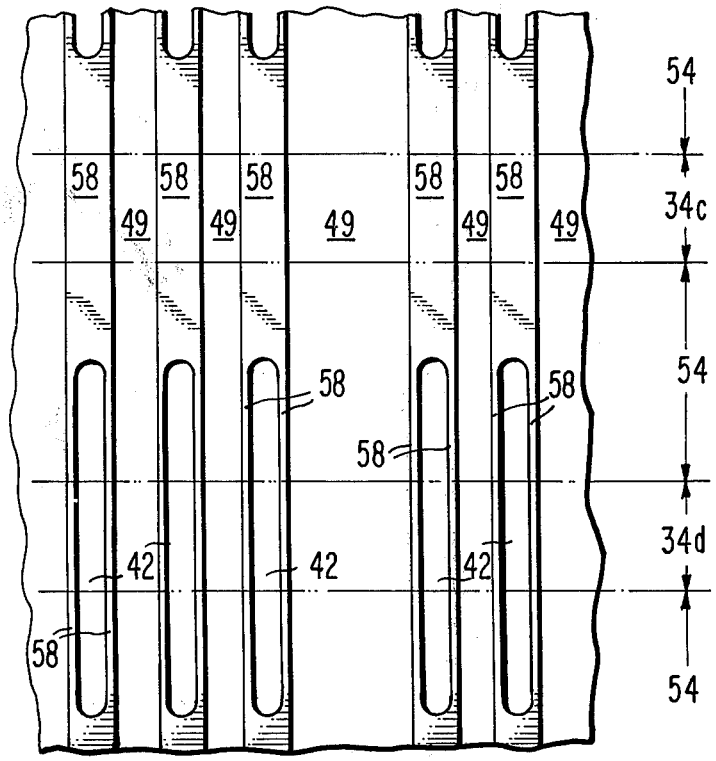
Fig. 4.
Fig. 7.
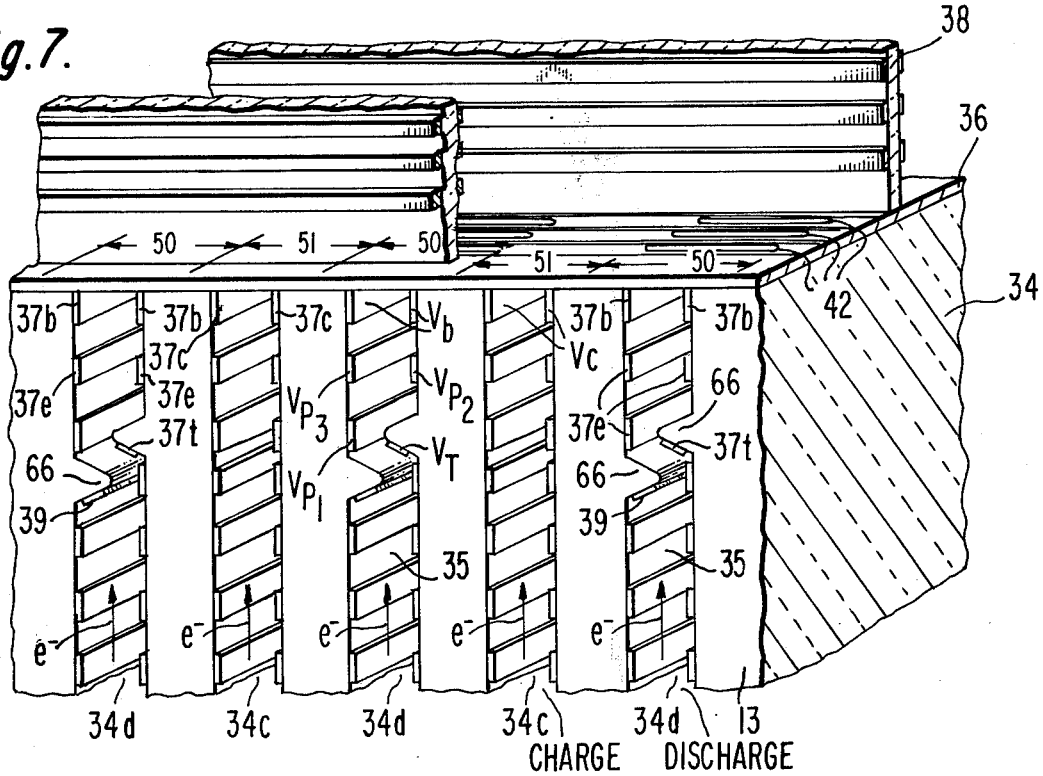

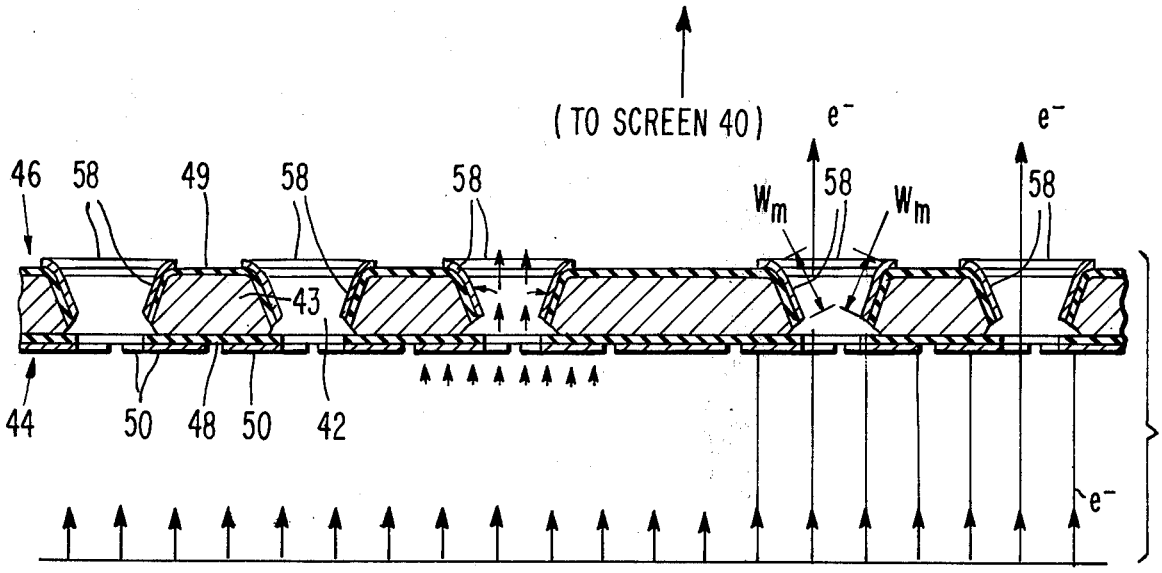
Fig.8.
Fig. 11.
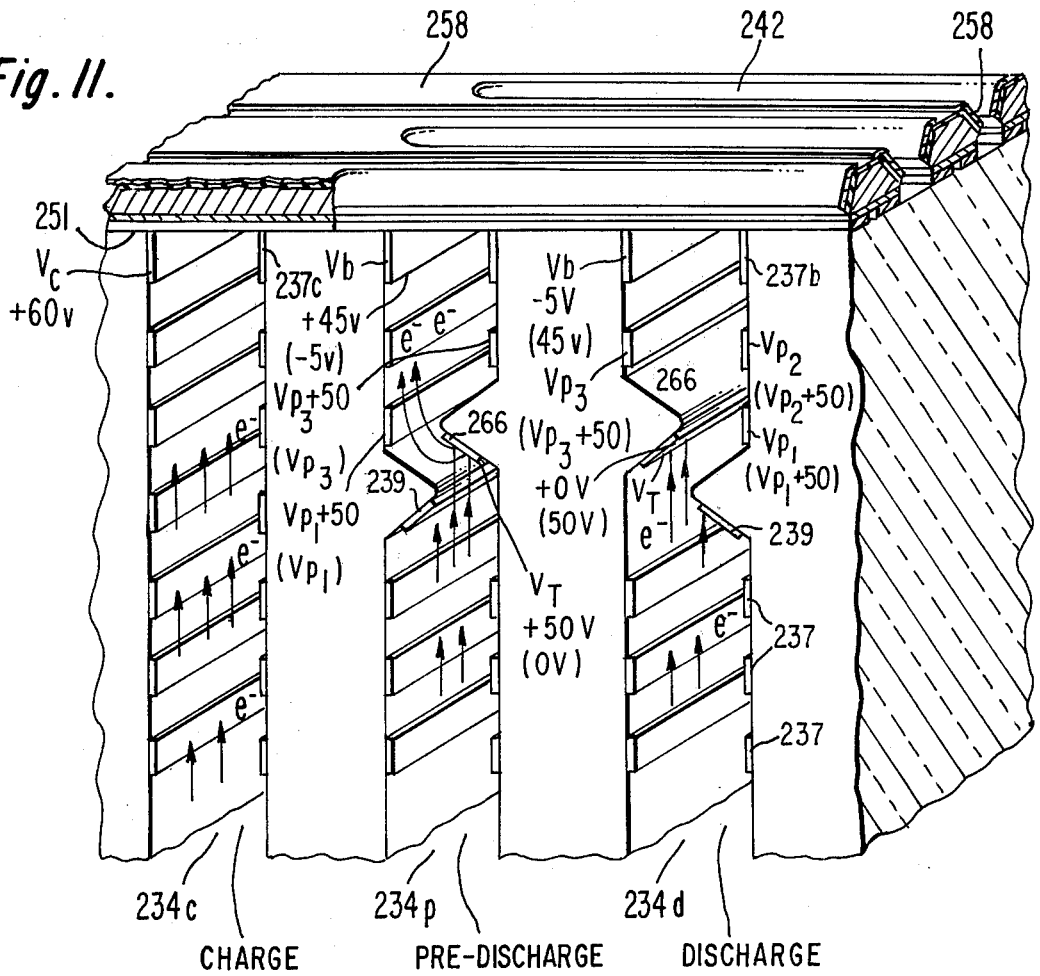

MODULATION MASK FOR AN IMAGE DISPLAY DEVICE

BACKGROUND OF THE INVENTION

This invention relates to an image display device, and particularly to a modulation mask for a flat cathodoluminescent image display device.

One form of a flat image display device which has been developed includes a multiplicity of cells. Each of the cells includes all the necessary components for forming at least a single element of an image display. Typically, each cell includes a source of electrons hereinafter referred to as the cathode, means for modulating a flow of electrons from the electron source, means for accelerating and focusing the flow of electrons, and a cathodoluminescent screen excitable by the accelerated flow of electrons. The device is operated by suitably addressing the cells in a desired sequence, e.g., a typical television scan.

In order to form a display having desirable characteristics, the flow of electrons must be accurately modulated. Typically, on-off modulation of a cell can be easily accomplished. However, gray-scale modulation, i.e., a selective gradation of the number of electrons permitted to strike the screen, is much more difficult to achieve. This is especially true in those circumstances wherein cathodoluminescent flat panel display schemes should simultaneously satisfy the requirements of about 1 percent element-to-element uniformity, high color purity, simple drive circuit requirements, low cost, and ease of construction. In addition, in such a flat image display device, large area cathodes generally have non-uniform output currents and require a modulation scheme using sampling and control of charge rather than control of current, to display uniformity.

Thus, the extended nature of the cathode in such a flat image display device can necessitate at least one charge sensing electrode for each one of the elements per display line, e.g., about 1800 to 2200 per line for a color display. The extended cathode also requires a given modulating electrode to provide access to every one of the approximately 500 display lines, i.e., each modulating electrode should have a length equal to the full image height. In a simple vertical charge sensing grid system of modulation, the modulating electrode and the charge sensing electrode are one and the same. However, this approach imposes a fundamental lower limit on the charge sensing electrode capacitance since the modulating electrode must extend for the full panel height if it is to modulate all 500 lines. In addition, the electrode must be a sizable fraction of the picture element width, if charge sensing is to be accurate and/or if line source current demands are not made excessive. The fundamental lower limit on the electrode capacitance in such a scheme results in a useless and excessive power loss in charging the modulating electrodes since line sources generally require relatively high voltages for modulation. Accurate sensing in such a scheme would require greater than an order of magnitude more line source charge than is necessary to achieve desired brightness levels.

Therefore, it would be desirable to develop a means for modulation i.e., a charge sensing modulation mask, in a flat image display device which can form a display having desirable characteristics without demanding an excessive amount of line source charge.

SUMMARY OF THE INVENTION

A substantially planar modulation mask for an image display device includes a metal sheet having a plurality of substantially identical apertures which are disposed in parallel rows and columns. A plurality of segmented charge sensing pads are disposed on but insulated from one surface of the metal sheet such that at least one of the sensing pads is in abutting relation with each of the apertures. Each of the sensing pads is disposed between the columns of apertures and extends for less than the full number of the rows of apertures. The sensing pads include a portion which extends beyond the abutting apertures. The extended portion includes a material having a high secondary emission ratio. A plurality of substantially parallel modulating electrodes are disposed on, but insulated from, the other surface of the metal sheet with each one of the modulating electrodes extending around one of the parallel columns of apertures.

BRIEF DESCRIPTION OF THE DRAWINGS

FIG. 1 is a partially broken away isometric view of an image display device which utilizes the modulation mask of the present invention.

FIG. 3 is a plan view of a portion of the modulation mask taken along line 3—3 of FIG. 2.

FIG. 4 is a plan view of a portion of the modulation mask taken along line 4—4 of FIG. 2.

FIG. 7 is a partially broken away isometric view of a portion of the image display device of FIG. 1.

FIG. 8 is a cross-sectional view of the modulation mask taken as in FIG. 5 showing the mechanism by which charge sensing and modulation is accomplished by the modulation mask of the present invention.

FIG. 11 is an isometric view showing a portion of another form of image display device which includes the modulation mask of the present invention.

DETAILED DESCRIPTION OF THE INVENTION

Figure 2:
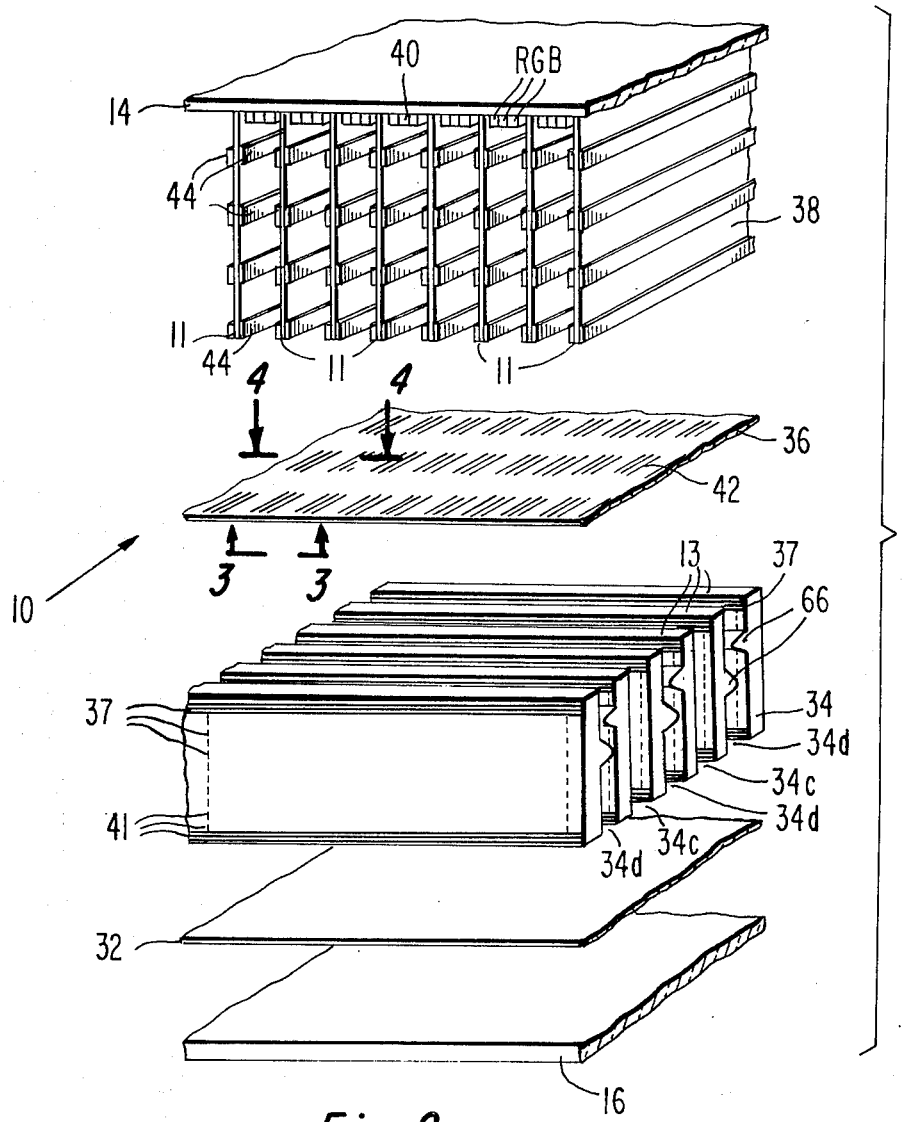
FIG. 2 is an exploded view of the image display device of FIG. 1.

One embodiment of a complete image display device 10 which employs the modulation mask of the present invention is shown in FIG. 1. The device 10 includes an evacuated glass envelope 12 having a flat transparent viewing front panel 14 and a flat back panel 16. The front and back panels 14 and 16 are parallel to each other and are sealed together by peripheral sidewalls 18, 20, 22 and 24. Sidewalls 18 and 22 include terminal areas which include a series of electrically conductive electrodes 26 extending therethrough to provide electrical conduction means for activating and controlling the device 10. In one embodiment, the overall dimensions of the device 10 are 75 cm high by 100 cm wide by 2.5 cm thick. The device 10 may have several different internal structures with at least one common property; the particular internal structure selected must be capable of supporting the front and back panels 14 and 16 of the glass envelope 12 against atmospheric pressures when the glass envelope 12 is evacuated.

The image display device 10 includes two orthogonal sets of parallel insulating vanes positioned between the front panel 14 and the back panel 16, as shown in FIG. 2. One set comprises vanes designated as 11; the other set comprises vanes designated as 13. A modulation mask 36 of the present invention is sandwiched between the two sets of orthogonal vanes 11 and 13. A large area cathode 32 is supported by the back panel 16. The cathode 32 may be a photoemissive material, such as barium, where optical feedback is employed as a means of sustaining cathode electron emission. High ion secondary emission cathode materials are suitable in situations where ion feedback is desirable as the means of sustaining cathode electron emission. The device 10 may be described as including a plurality of cells, or picture elements, each cell of which correspond to the intersections of the two orthogonal sets of vanes 11 and 13 respectively, and a modulation mask 36 therebetween.

The parallel vanes 13 function as an electron multiplier section 34. The multiplier section 34 is divided into a plurality of electron multipliers which are determined by each consecutive pair of vanes 13. The multiplier section 34 may be referred to as including a plurality of line electron multipliers 34d and 34c arranged in alternate fashion. The line multipliers **34*d* and 34*c* each include a plurality of dynodes 41 included on the opposing surfaces between each pair of vanes 13. The geometric configuration of the dynodes 41 is such that electrons emitting from the surface of one dynode are steered to the surface of the next dynode when appropriate voltages are applied. The dynodes 41** are of a material having a high secondary emission ratio $\delta$, e.g., magnesium oxide ($\delta$ greater than 2.0).

Each of the line multipliers **34*d* and 34*c* includes a plurality of electrodes 37 which extend parallel to its major axis. The electrodes 37 are disposed on the opposing surfaces between each pair of vanes 13. One pair of these electrodes 37, further designated as potential barrier electrodes 37*b*, is disposed at one end of the line multiplier 34d in proximate relation to the modulation mask 36, as shown in FIG. 7. A structurally similar pair of electrodes 37, further designated as collector electrodes 37*c*, is disposed at one end of the line multiplier 34*c* in proximate relation to the modulation mask 36.**

Figure 6:
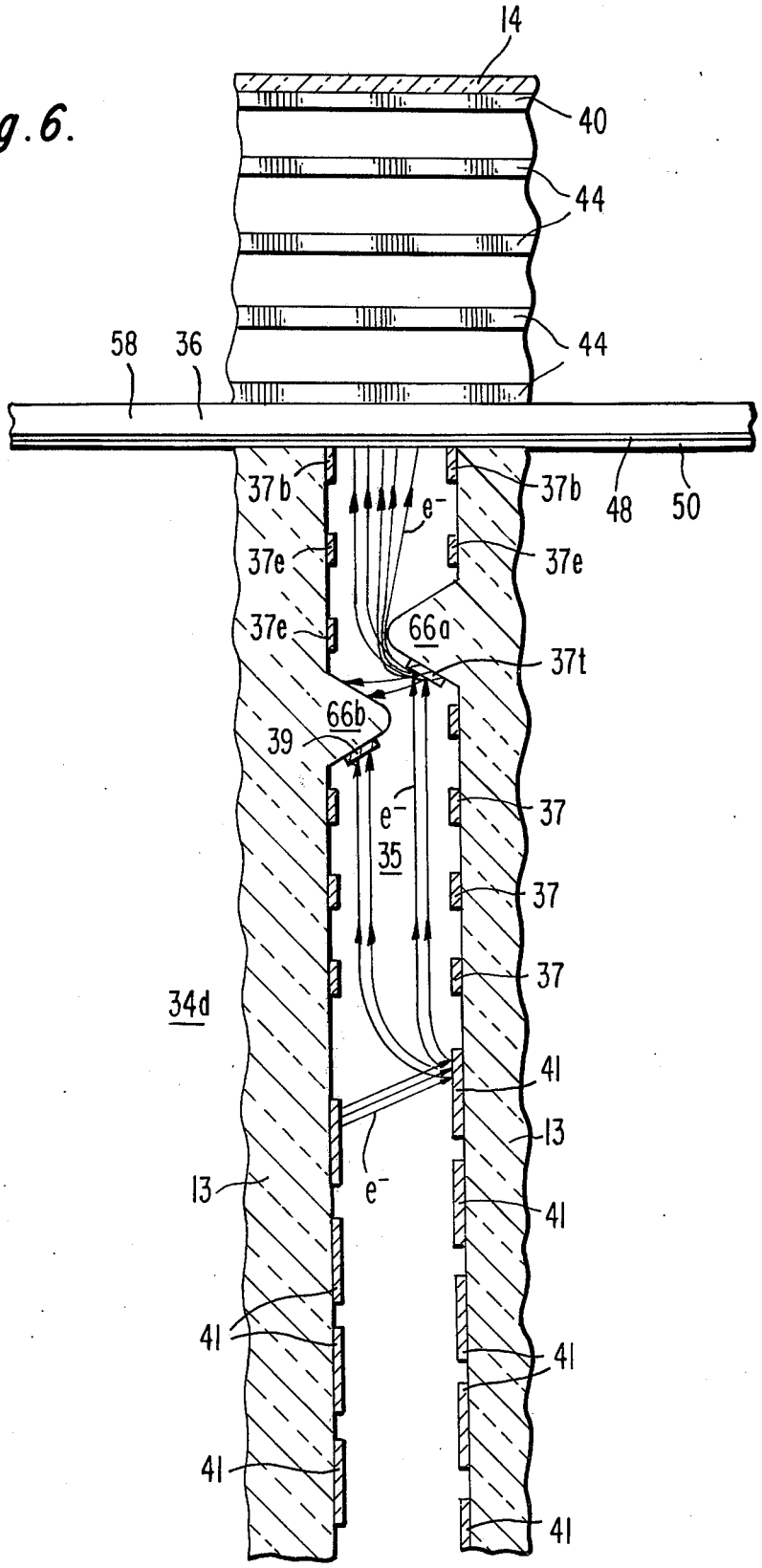
FIG. 6 is a sectional view of one cell in the image display device of FIG. 1 showing the mechanism by which a line source of electrons is achieved.

Each of the line multipliers 34d includes a high energy electron filter 66, as shown in FIGS. 2, 6 and 7. The filter 66 is defined by protrusions 66a and 66b which extend from the vanes 13, as clearly shown in FIGS. 6 and 7. The shape of the protrusions **66*a* and 66*b* is such that the filter 66 is optically opaque, i.e., there is no straight path therethrough. An electrode 37, further designated as target electrode 37*t* is disposed on the surface of the protrusion 66*a* which faces the protrusion 66*b*. Electrodes 37, further designated as extract electrodes 37*e*, are disposed between the potential barrier electrodes 37*b* and the filter 66. The surface of the protrusion 66*b* which faces into the line multiplier 34*d* can be coated with a body 39 of a material which will create photon feedback to the cathode 32. For example, the body 39** may be a phosphor material, such as lanthanum phoshate, cerium doped.

The line multipliers **34*c* are substantially the same as the line multipliers 34*d* with which they are interlaced. An important structural distinction is that the line multiplier 34*c* need not have the high energy electron filter 66, as shown in FIG. 7. The line multipliers 34*c*** can have a UV phosphor disposed at their output end (not shown) if optical feedback is desired.

The other set of parallel vanes 11 functions as the accelerating and focussing section 38, as shown in FIG. 2. The accelerating and focussing section 38 may be a relatively open structure which is sandwiched between the cathodoluminescent screen 40 and the modulation mask 36. The screen 40 comprises parallel phosphor stripes which are located on the inner surface of the front panel 14. Several phosphor stripes, e.g., Red (R), Green (G), and Blue (B), are disposed between each consecutive pair of parallel vanes 11. The phosphor stripes are parallel with the vanes 11 of the accelerating and focussing section 38. A plurality of electrodes 44 are disposed on the opposing surfaces between each consecutive pair of vanes 11.

The modulation mask 36 is a substantially planar body having a plurality of identical apertures 42 therein, preferably in the form of slots, which are disposed in parallel rows and columns, as shown in FIG. 2. The columns of slots 42 are disposed with their major axes aligned with the corresponding phosphor stripes of the cathodoluminescent screen 40. Each consecutive pair of vanes 11 in the accelerating and focussing section 38 includes three columns of slots 42 and the three corresponding phosphor stripes, although greater or lesser numbers of stripes and slots may be included. The slots 42 are of a length ($L_s$) at least sufficient to equal the opening defined by each line multiplier **34*d* and are of a width ($W_s$) sufficient to correspond to each of the phosphor stripes (FIG. 3**).

Figure 5:
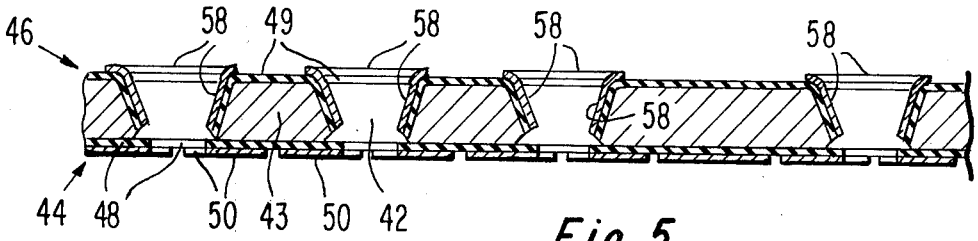
FIG. 5 is an enlarged cross-sectional view of the modulation mask taken along line 5—5 of FIG. 3.

The modulation mask 36 includes a substantially planar thin metal sheet 43, e.g., less than 0.025 cm thick, as can be more clearly seen in FIG. 5. Suitable materials include those which can be conveniently worked and which are electrically conductive, e.g., aluminum or aluminum-magnesium alloys. For purposes of description, the sheet 43 includes surfaces 44 and 46. The slots 42 in the sheet 43 are shaped with a narrow end on the surface 44 and a wide end on the surface 46 so that the edges of the slots taper away from the narrow end of the slot. The slots 42, for example, may have a width ($W_s$) of 75 microns (narrow end) and a length ($L_s$) of 0.075 cm. On the surfaces 44 and 46 of the sheet 43 are insulating layers 48 and 49, respectively, as shown in FIG. 5. The insulating layers 48 and 49 are of a material which is a relatively good insulator, such as aluminum oxide, having a thickness of about 25 to 50 microns. A plurality of substantially identical charge sensing pads 50, e.g., metal contacts of aluminum, are disposed on the insulating layer 48 as can be seen more clearly in FIG. 3. The sensing pads 50 are disposed between the columns of slots 42. Each one of the slots 42 is in abutting relation with a separate pair of identical sensing pads 50. The charge sensing pads are segmented, i.e., they extend for less than the full number of rows of slots 42. In order to obtain the segmented charge sensing pads 50, it is necessary to provide sensing pad separations 52. Each of the sensing pads 50 actually completes a capacitor which comprises the metal sheet 43, the insulating layer 48 and the metal contact (sensing pad 50), as shown in FIG. 5.

Each sensing pad 50 includes a portion 51 which extends beyond the length of the slot 42, as shown in FIG. 3. The extended portion 51 has on its surface a material having a high secondary emission ratio. By a high secondary emission ratio, or coefficient, it is meant those materials having secondary emission ratios greater than about 1, i.e., metal oxides, such as aluminum oxide, and most metals including aluminum. The extended portion 51 of the sensing pad 50 can be provided by extending the metal sensing pad 50 beyond the slot 42, i.e., the sensing pad 50 and the extended portion 51 can be part of an electrically continuous body.

A plurality of substantially parallel modulating electrodes 58 are disposed on the insulating layer 49 which is on the surface 46 of the metal sheet 43, as shown in FIGS. 4 and 5. Each modulating electrode 58 extends around one of the parallel columns of slots 42. In the slot 42; the modulating electrode 58 is disposed on the insulating layer 49 on the sides of the slot so as to taper away from the narrow end of the slot. The modulating electrodes 58 should be an electrical conductor, e.g., a metal such as aluminum. In contrast to the segmented sensing pads 50, the modulating electrodes 58 extend for the full number of parallel rows of slots 42, i.e., they are not segmented, as shown in FIG. 4.

The modulating mask 36 can be constructed through area processing techniques which are capable of forming an array of capacitance pads whose dimensions and capacitances are controllable to about 1 percent. The slots 42 can be formed by embossing an aluminum sheet 43 with an embossing tool whose dimensions have been photolithographically defined. The insulating layer 48 can be obtained by standard anodization techniques wherein the anodizing follows the embossing contours. As a result of the anodization, the surface of the aluminum is transformed into aluminum oxide. By limiting the anodization time, an aluminum oxide insulating layer can be formed which is 25 to 50 microns in thickness, as desired. Then, the insulating layer can be selectively etched to form the insulating layers 48 and 49. Metal contacts, i.e., sensing pads 50, and the modulating electrodes 58 can then be deposited, through any well known technique, e.g., evaporated and then defined through the use of well known photolithographic techniques.

The relative orientation of the elements in the display device 10 can be further described by referring to FIGS. 3 and 7. The major axes of the line multipliers **34*d* and 34*c* are in orthogonal relation to the major axes of the slots 42, as shown in FIG. 7. The output of the line multipliers 34*d* is directed toward the slots 42 and abutting sensing pads 50, as shown in FIG. 3. The negative barrier potential electrodes 37*b* are in proximate relation with the slots 42 and abutting sensing pads 50, as shown in FIG. 7. The output of the line multiplier 34*c* is directed toward the extended portions 51 of the sensing pads 50 as in FIG. 3. The collector electrodes 37*c* are in proximate relation with the extended portions 51 of the sensing pads 50, as shown in FIG. 7**.

Between the outputs of each line multiplier **34*d* and 34*c* is a multiplier dead area 54, i.e, an area where there is no output, as shown in FIG. 3. The sensing pad separations 52 are positioned to lie in the dead area 54. Modulation mask inhomogenities can be reliably isolated in a multiplier dead area 54** even if multiplier construction or mask alignment techniques are somewhat imprecise.

The operation of the modulation mask 36 of the present invention can now be described generally by referring to FIGS. 2, 6, 7 and 8.

When the mask 36 is used in conjunction with the feedback multiplier type line electron sources **34*d* previously described, a line source of electrons is provided by applying voltages to the multiplier dynodes 41. In such a case, any spurious electron emitted near the multiplier cathode 32 will be allowed to pass up through and be multiplied within the multiplier 34*d*, producing $G_m$ electrons as the multiplier output, where $G_m$ is the multiplier gain. When the surfaces or volume near the output end 35 of the line multiplier 34*d* are coated or filled with gas or fluorescent species, e.g., element 39 of FIGS. 6 and 7, gas ions or light can be formed by bombarding electrons. In such a case, a certain number of gas ions or light photons will be able to pass back through the open multiplier 34*d* and strike the multiplier cathode 32. These ions or photons can produce additional cathode electrons. If the multiplier gain $G_m$ is sufficiently large, the ions or photons created near the multiplier output end 35 by the multiplication of a single cathode electron will feedback to the cathode 32 so as to produce more than an additional cathode electron. In this manner, current at the cathode 32 and within the multiplier 34*d* will continue to grow exponentially in what is termed "regenerative feedback" leading to sustained electron emission. The output current of the line electron multiplier 34*d* will eventually cease to grow through some mechanism, such as electronic space charge saturation. In this manner, the feedback multiplier 34*d*** can be made to provide a line source of electrons.

As will later be described, the sensing pads 50 are provided with an initial electrical charge Q, where $Q = CV$. As previously described, the sensing pad 50 is on the insulating layer 48 such that the pad 50 has a predetermined capacitance (C) to the metal sheet 43. The capacitance can be charged to a desired uniform voltage level (V). Once each of the pads is charged to this level, only a substantially uniform maximum electrical charge can pass into each of the slots which are abutted by the pads as the pads are discharged.

Each time a charge is directed through a slot 42, a picture element lights up on the screen 40. The directed charge can come from the line multipliers **34*d* which perform the function of creating the electrons which illuminate each of the display elements on the screen 40. The output of the line multiplier 34*d* also causes the previously charged sensing pads 50 to discharge to cutoff. These line multipliers can be referred to as DISCHARGE multipliers 34d since their function is to discharge the sensing pads 50. Once the sensing pads 50 are completely discharged, in order for that particular slot 42 or row of slots to be capable of passing additional display element charge to the screen 40 at a later time, the sensing pads 50 which abut the slot 42 must be charged again, preferably to their former desired voltage level. The charging of the sensing pad 50 can be obtained through secondary emission from the extended portion 51 of the sensing pad 50. For example, the output of the line multipliers 34*c*, i.e., CHARGE multipliers 34*c*, can be used to bombard the extended portions 51 with high energy electrons, as shown in FIG. 7. The CHARGE multipliers 34*c* are used exclusively to charge previously discharged sensing pads 50 back to the desired uniform level through secondary emission from the extended portions 51 of the sensing pads 50.**

Referring now to FIGS. 6 and 7, the invention can be more fully described. Assuming the sensing pads 50 to be initially charged to the uniform desirable voltage level, the description will begin with the operation of the DISCHARGE multipliers 34d. Electrons (*e*-) leave the final dynode member 41, and high energy electrons are filtered out, e.g., through the use of the high energy electron filter 66, shown in FIG. 6. High energy electrons cannot pass through the filter 66 since there is no straight path therethrough. Although high energy electrons from the electron multiplier 34d are eliminated by the filter 66, lower energy second emission electrons created on the target electrode 37t, which are at a potential of $V_T$, are selectively extracted and accelerated towards the mask 36 by extract electrodes 37*e* having positive voltages $V_{P1}$, $V_{P2}$ and $V_{P3}$, as shown in FIG. 7. As employed herein, all electrical potentials are described in reference to the target voltage $V_T$, which is normally at ground potential (0 volts).

A negative voltage $V_b$, e.g., -5 volts, is applied to the negative barrier potential electrodes 37*b* in the DISCHARGE multiplier 34*d*. The electrons are initially drawn through the negative barrier voltage $V_b$ with some striking the abutting sensing pads 50 and some passing through the slots 42 toward the screen 40, as shown in FIG. 8. The electrodes 37*b* which provide the negative barrier voltage ($V_b$) prevent any secondary electrons from escaping from the portions of the sensing pads 50 which abut the slot 42 so the pads 50 will charge negatively until the current passing the negative barrier electrodes 37*b* is asymptotically cut off.

Even an asymptotic cut-off of the current is sufficient to insure that each region of the modulation mask along the multiplier line source is exposed to enough charge so as to drive its sensing pads to the common cut-off voltage. However, it is necessary that the multiplier line source be kept reasonably uniform, through, for example, space charge limitation of the line source current prior to passing through the high energy electron filter 66. Thus, when the sensing pads become sufficiently negative, i.e., at cut-off voltage, substantially no more electrons can pass into each slot. The same principle of operation applies to the complete display device which includes a plurality of multiplier line sources.

It should be noted that the optically opaque high energy electron filter is necessary when using the mask 36 with a secondary emission line source, e.g., feedback multipliers, because secondary emission cathodes typically produce electrons which energies which are quite high. The discharging sensing pads 50 discharge asymptotically to the negative energy of the most energetic source electron so that the final pad voltage may be quite uncertain if these high energy electrons are not filtered.

Since, as previously mentioned, the planar modulation mask 36 may be constructed using area processing techniques including, for example, photolithography, the slot widths, sensing pad areas and insulator thicknesses can all be held accurate to within about 1 percent. Thus, one can insure that the capacitances formed by the sensing pad, insulating layer, and metal sheet can be held uniform to about 1 percent. One can also insure that the slots sample a constant fraction of the current sampled by the pads. By additionally insuring that both the initial voltage to which pads are charged and final voltage to which they discharge varies by less than about 1 percent from pad to pad, one may achieve a situation in which the charge transmitted by the unmodulated slots varies by less than about 1 percent element to element, as desired.

The description will now continue with the operation of the CHARGE multipliers 34*c*, shown in FIG. 7. At this point in time, the sensing pads 50 are in a discharged state. Since the CHARGE multiplier 34*c* does not include a high energy electron filter, electrons from the CHARGE multipliers 34*c* strike the modulation mask 36 with kinetic energies much greater than the energies of the electrons from the DISCHARGE multiplier 34*d*. Consequently, the CHARGE multipliers 34*c* provide electrons with sufficient kinetic energies to produce secondary emissions ratios on the extended portions 51 of the sensing pads 50 which are greater than one.

A positive voltage $V_c$ , e.g., +50 volts, is applied to the collector electrodes 37*c* in the CHARGE multiplier 34*c*. The positive voltage on the collector electrode 37*c* functions to collect the secondary emission from the extended portion 51 of the charge sensing pads 50. Consequently, the charge sensing pads 50 are pulled up to $V_C \approx +50$ volts, their initial desired value. Hence, the CHARGE multiplier 34*c* includes collector electrodes 37*c* which correspond in structure, but not in function, to the potential barrier electrodes 37*b* of the DISCHARGE multiplier 34*d*.

The push-pull operation of the CHARGE-DISCHARGE multipliers becomes clear in FIG. 7. By push-pull it is meant the alternate charging and discharging of the sensing pads. The sensing pads 50 are set initially at a positive voltage, e.g., +50 volts, then the DISCHARGE multiplier 34*d* line source is fired with currents saturating to comparable levels along that line for an effective period, e.g., about 1 microsecond. Within this time, the sensing pads 50 discharge back to ~0 volts and a set charge dependent only on the slot width and the sensing pad capacitances passes into each slot in the modulation mask, as previously described.

The DISCHARGE multiplier 34*d* is then turned off and the CHARGE line multiplier 34*c* is fired in a similar fashion, so as to provide a similar line current. If the DISCHARGE line source 34*d* provides enough current to discharge the sensing pad 50, then the CHARGE line sources 34*c* at the same current level induces a comparable charge of secondary electrons from the bombarded extended portion 51 of the sensing pads 50. The secondary electrons from the bombarded extended portion 51 are then collected by the collector electrodes 37*c*. Consequently, the sensing pads 50 are again charged to their desired value, i.e., pulled up. At this point the cycle is complete, i.e., slots 42 which abut the charged sensing pads 50 are again ready to pass charge to the screen 40. There is no increased requirement on electron multiplier current density in the charge multiplier and the secondary-emission-limited lifetime of a device utilizing both DISCHARGE and CHARGE multipliers, as herein described, is substantially the same as the lifetime of a device utilizing only the anode-illuminating DISCHARGE multipliers.

Having created a uniform maximum charge source through the use of space charge limitation and segmented charge sensing pads 50, it is now possible to use voltage control of relatively low magnitudes to modulate the substantially uniform charge packets which pass into each slot 42, i.e., to obtain gray scale modulation. The voltage control may be analogue or digital and will typically include applying an appropriate voltage to each modulating electrode 58 which includes one of the columns of slots 42. An applied analogue voltage varying by up to 50 volts would be suitable for producing the desired analogue modulation for a satisfactory display. As shown in FIG. 8, the modulating electrodes 58 function to allow only a desired fraction of the electrons, which have reached the slots 42, to pass out of the slots and continue toward the screen 40. Also, it can now be observed that secondary emission from the modulating electrodes 58 is substantially prevented due to the manner in which the modulating electrodes 58 taper away from the narrow end of the slot 42. The voltage necessary to effectively modulate the electrons, which pass into and through the slots 42, is minimized by keeping the width ($W_m$), i.e., in the slot 42, of the modulating electrodes 58 as large as possible.

Figure 9A:
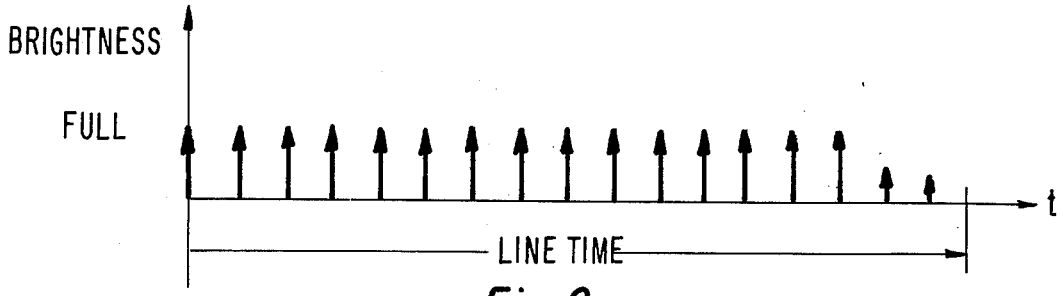
FIGS. 9*a* and 9*b* are graphs showing typical waveforms which can be utilized in a digital modulation scheme with the modulation mask of the present invention.
Figure 9B:
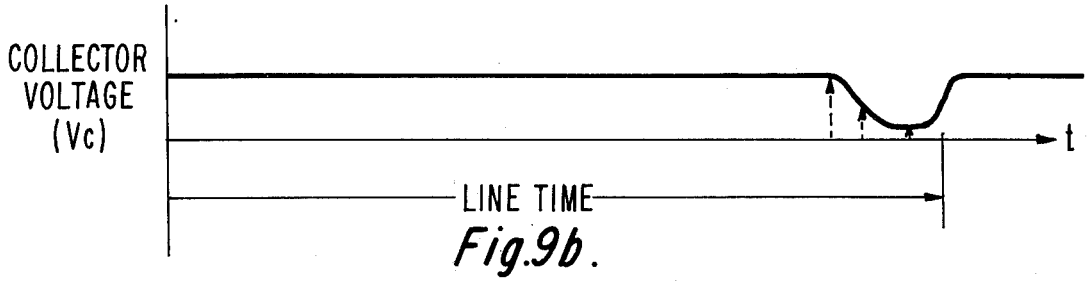

The modulation mask 36 is particularly well suited for a digital modulation scheme. For example, 64 level digital modulation with the modulation mask of the present invention could be accomplished simply by charging and discharging the sensing pads a total of 64 times each multiplier line time. Gray scale modulation to an accuracy of about 1 percent of full brightness could then be accomplished by allowing the modulating electrodes to pass only a fractional number of the 64, equal charge, pulses. A slightly more complex approach which allows for far fewer charge and discharge pulses per line time would be to arrange for more than one charge pulse level for each charge-discharge cycle on the mask. This can be accomplished by shifting the collector voltage $V_C$ on the CHARGE multiplier 34*c* collector electrode such that the pad can be initially charged to a voltage biased to the collector electrode voltage $V_C$. The total number of required pulses per line time can thus be greatly reduced with only a slight increase in the number of biased pulse charge levels. For example, while a single pulse charge level requires 64 pulses per line time to give 64 levels, three pulse charge levels (full, half and quarter of full) could allow for a 63 level display with only 17 pulses per line time, as indicated in FIGS. 9*a* and 9*b*.

Although the modulation mask 36 of the present invention has been described as having a particular structure, other variations are possible and in certain instances, may even be preferable. For example, it is not always necessary that the sensing pads be substantially identical, especially in area. As previously described, each of the identical sensing pads was exposed to substantially the same length of multiplier output, i.e., along the major axis of the line multiplier. However, it is permissible, perhaps preferable, for one sensing pad to have a greater width than another pad as long as the one pad intercepts a correspondingly greater length of multiplier output and as long as the one pad exhibits a correspondingly greater capacitance. That is, it is desirable to keep substantially constant the ratio of the width of the pad to the capacitance of the pad. In addition, if desired, the two separate insulating layers for the sensing pads and the modulating electrodes can be combined into a single insulating layer which completely covers the metal sheet.

Figure 10:
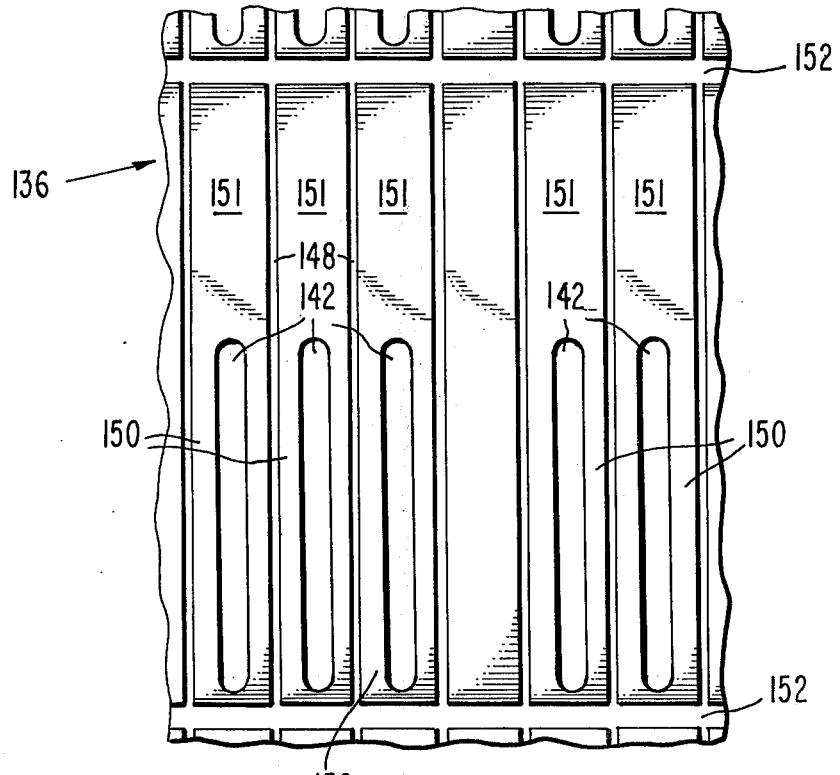
FIG. 10 is a plan view taken as in FIG. 3 showing another form of the modulation mask of the present invention.

A variation of the previously described modulation mask 36 is shown in FIG. 10. The modulation mask 136, shown partially in FIG. 10, includes a reduced number of sensing pads 150 as compared to the structure shown in FIGS. 3–5. That is, each of the slots 142 is in abutting relation with a single sensing pad 150 which surrounds the slot. The structure shown in FIG. 10 reduces the regions where the insulating layer 148 is exposed to the output of the multiplier section. This may be desirable since the charging of insulators often leads to unpredictable results.

Although the modulation mask of the present invention has been described wherein a DISCHARGE multiplier and a CHARGE multiplier are used in a two phase system, i.e., discharge (display) and charge, it may be preferable to more exactly set the initial sensing pad voltages through the use of a three phase system. For example, as shown in FIG. 11, secondary emission from the extended portion 251 of the sensing pad 250 over an open (unfiltered) CHARGE multiplier 234*c* can be used to charge the sensing pad positive to near the +60 volt collect voltage $V_c$. However, the secondary emission in this charge phase is highly sensitive to space charge effects so that a second multiplier pulse from the structurally closed and filtered PRE-DISCHARGE multiplier 234*p* can be used to more accurately set the initial sensing pad voltage, for example, to about +50 volts, in a manner far less sensitive to space charge. That is, the PRE-DISCHARGE multiplier 234*p* functions to discharge the sensing pads from their voltage obtained through secondary emission to the desired initial voltage. Consequently, three pulsing phases consisting of two pulses to set the initial sensing pad voltage, and one display pulse, i.e., discharge pulse, to drive the sensing pads to their final cutoff voltage, can be provided for more exact setting of the initial sensing pad voltages. In such a case, the extended portions 251 of the sensing pads 250 are disposed over the open CHARGE multipliers 234*c*, i.e., having no high energy electron filter, while the slot 242 and abutting sensing pads 250 are disposed over the PRE-DISCHARGE and DISCHARGE multipliers (234*p* and 234*d*) having opaque high energy electron filters 266. The functions of the PRE-DISCHARGE and DISCHARGE multipliers beneath the slot 242 reverse each field time one-sixtieth sec.). Thus, the 50 volt changes in target ($V_t$) and other voltages i.e., $V_p$ and $V_b$, (shown parenthetically in FIG. 11), need only be changed each field-time.

An important feature of the present invention is that the separation of the charge sensing and the modulation functions in the modulation mask permits the charge sensing electrodes to be segmented into lengths which are much smaller than the full number of rows of slots, i.e., lengths which are much smaller than the full image height, while still providing for modulation. Consequently, sensing pad capacitances are reduced such that stringent control can be achieved without demanding an excessive amount of anode charge. Further, the low sensing pad capacitances allow the use of digital modulation with good gray scale since the sensing pads can be pulsed many times within one multiplier line-time with each pulse representing a small amount of charge.

Although the modulation mask of the present invention has been described in use in a flat image display device which employs a feedback mechanism, i.e., ion and/or photon feedback in conjunction with electron multipliers, the modulation mask of the present invention can be utilized to modulate and insure uniformly with other types of line electron sources. Further, although the modulation mask has been described as having slot shaped apertures, other aperture shapes may be employed, e.g., circular or square shaped apertures. Thus, there is provided by the present invention, a modulation mask suitable for use in an area cathode cathodoluminescent flat image display device. The modulation mask can be used to produce a display having desirable characteristics.

We claim:

1. A substantially planar modulation mask for an area cathode cathodoluminescent image display device, which comprises:

a metal sheet having a plurality of substantially identical apertures which are disposed in parallel rows and columns, a plurality of segmented charge sensing pads disposed on but insulated from one surface of said metal sheet with at least one of said sensing pads in abutting relation with each of said apertures, each one of said sensing pads being disposed between said columns of apertures and extending for less than the full number of said rows of apertures, said sensing pads including a portion which extends beyond said abutting apertures, said extended portion including a material having a high secondary emission ratio, and a plurality of substantially parallel modulating electrodes disposed on but insulated from the other surface of said metal sheet with each one of said modulating electrodes extending around one of said parallel columns of apertures.

2. A modulation mask in accordance with claim 1 in which said apertures are slot shaped with the major axes of said slots disposed along said columns.

3. A modulation mask in accordance with claim 2 in which the majority of said sensing pads are in abutting relation with the greater part of the entire length of each one of said slots.

4. A modulation mask in accordance with claim 3 in which each slot is in abutting relation with a separate pair of said sensing pads with said slot being included between said pair of sensing pads.

5. A modulation mask in accordance with claim 3 in which each of said slots is in abutting relation with a single sensing pad which surrounds said slot.

6. A modulation mask in accordance with claim 2 in which each of said slots has a narrow end on said one surface of said metal sheet and a wide end on said other surface with sides which taper away from said narrow end, said modulating electrode being disposed on said sides.

7. A modulation mask in accordance with claim 6 in which said metal sheet comprises aluminum.

8. A modulation mask in accordance with claim 7 in which said modulating electrodes and said sensing pads are insulated from said metal sheet through separate regions of anodized aluminum.

9. An image display device which includes line sources of electrons, means for modulating a flow of electrons from said line sources, means for accelerating and focussing said modulated flow of electrons, and a cathodoluminescent screen excitable by the modulated and accelerated flow of electrons, wherein said means for modulating said flow of electrons includes a substantially planar modulation mask, which comprises:

a metal sheet having a plurality of substantially identical apertures which are disposed in parallel rows and columns, a plurality of segmented charge sensing pads disposed on but insulated from one surface of said metal sheet with at least one of said sensing pads in abutting relation with each of said apertures, each one of said sensing pads being disposed between said columns of apertures and extending for less than the full number of said rows of apertures, said sensing pads including a portion which extends beyond said abutting apertures, said extended portion including a material having a high secondary emission ratio, and a plurality of substantially parallel modulating electrodes disposed on but insulated from the other surface of said metal sheet with each one of said modulating electrodes extending around one of said parallel columns of apertures.

10. An image display device in accordance with claim 9 in which said apertures are slot shaped with the major axes of said slots disposed along said columns in orthogonal relation to said line sources.

11. An image display device in accordance with claim 10 in which said sensing pads are in abutting relationship with said slots for at least the length of said slots which is exposed to said electron flow from said line electron sources.

12. An image display device in accordance with claim 11 in which each slot is in abutting relation with a separate pair of said sensing pads with said slot being included between said pair of sensing pads.

13. An image display device in accordance with claim 11 in which each of said slots is in abutting relation with a single sensing pad which surrounds said slot.

14. An image display device in accordance with claim 11 in which said screen includes a plurality of substantially parallel phosphor stripes with each one of said slots being aligned with one of said phosphor stripes.

15. An image display device in accordance with claim 11 in which each of said line electron sources includes a plurality of electrodes extending parallel to the major axes of said line electron sources, some of said line sources including collector electrodes and the other of said line sources including potential barrier electrodes, said collector electrodes being in proximate relation to said extended portion of said sensing pads such that secondary emission can be drawn from said extended portion of said sensing pad to said collector electrodes whereby said sensing pad can be electrically charged to the voltage on said collector electrodes, said potential barrier electrodes being in proximate relation to the remaining portion of said sensing pads such that secondary electrons can be substantially prevented from escaping from said remaining portion of said pad whereby said sensing pad can be electrically discharged.

16. An image display device in accordance with claim 15 in which the secondary emission ratio of said extended portion of said sensing pad is of sufficient magnitude such that substantially the same magnitude of said line electron flow can be used to charge and discharge said sensing pads.

17. An image display device in accordance with claim 15 in which said line sources of electrons include line electron multipliers open to feedback of sufficiently high gain to produce regenerative feedback and sustained electron emission.

18. An image display device in accordance with claim 17 wherein each of said sensing pads is exposed to the output of at least a consecutive pair of said line multipliers, at least one of said line multipliers including an optically opaque high energy electron filter, said filter being disposed between the output of said line multiplier and said modulation mask.

19. An image display device in accordance with claim 18 in which said extended portions of said sensing pads along one of said rows of slots are exposed to the output of one of said line multipliers and said slots and said remaining portions of said sensing pads are exposed to the output of at least one other of said line multipliers with said other multiplier including said optically opaque high energy electron filter.

20. An image display device in accordance with claim 18 in which each of said sensing pads is exposed to the output of three consecutive line multipliers wherein said extended portion of said sensing pad is exposed to one of said line multipliers.

21. An image display device in accordance with claim 20 in which each row of said slots corresponds to two lines on said cathodoluminescent screen and in which each of said slots and said abutting sensing pads are exposed to the output of the remaining two of said three consecutive line multipliers, each of said two line multipliers including said high energy electron filters.

22. An image display device in accordance with claim 21 in which each of said slots has a narrow end on said one surface of said metal sheet and a wide end on said other surface with sides which taper away from said narrow end, said modulating electrode being disposed on said sides.

23. An image display device in accordance with claim 22 in which said metal sheet comprises aluminum.

24. An image display device in accordance with claim 23 in which said modulating electrodes and said sensing pads are insulated from said metal sheet through separate regions of anodized aluminum.

* * * * *